US007704192B2

(12) United States Patent
Dyer et al.

(10) Patent No.: US 7,704,192 B2
(45) Date of Patent: Apr. 27, 2010

(54) ELLIPTICAL EXERCISE EQUIPMENT WITH ADJUSTABLE STRIDE

(75) Inventors: David E. Dyer, Renton, WA (US); Franklin C. Marti, Clinton, WA (US); Jonathan M. Stewart, Seattle, WA (US); Gregory B. May, Seattle, WA (US); David L. Albert, Woodinville, WA (US)

(73) Assignee: Precor Incorporated, Woodinville, WA (US)

( * ) Notice: Subject to any disclaimer, the term of this patent is extended or adjusted under 35 U.S.C. 154(b) by 1471 days.

(21) Appl. No.: 11/060,123

(22) Filed: Feb. 17, 2005

(65) Prior Publication Data

US 2006/0183605 A1 Aug. 17, 2006

(51) Int. Cl.
*A63B 22/06* (2006.01)
*A63B 22/04* (2006.01)

(52) U.S. Cl. ..... 482/52; 482/57

(58) Field of Classification Search ..... 482/51–53, 482/57–63

See application file for complete search history.

(56) References Cited

U.S. PATENT DOCUMENTS

| | | | | |
|---|---|---|---|---|
| 5,743,834 A | | 4/1998 | Rodgers, Jr. | 482/57 |
| 5,919,118 A | * | 7/1999 | Stearns et al. | 482/51 |
| 5,921,894 A | | 7/1999 | Eschenbach | 482/57 |
| 5,993,359 A | | 11/1999 | Eschenbach | 482/57 |
| 6,024,676 A | | 2/2000 | Eschenbach | 482/51 |
| 6,027,430 A | | 2/2000 | Stearns et al. | 482/51 |
| 6,027,431 A | | 2/2000 | Stearns et al. | 482/52 |
| 6,042,512 A | | 3/2000 | Eschenbach | 482/52 |
| 6,045,488 A | | 4/2000 | Eschenbach | 482/52 |
| 6,077,196 A | | 6/2000 | Eschenbach | 482/51 |
| 6,077,198 A | | 6/2000 | Eschenbach | 482/52 |
| 6,090,013 A | | 7/2000 | Eschenbach | 482/52 |
| 6,090,014 A | | 7/2000 | Eschenbach | 482/52 |
| 6,168,552 B1 | | 1/2001 | Eschenbach | 482/52 |
| 6,183,398 B1 | | 2/2001 | Rufino et al. | 482/57 |
| 6,196,948 B1 | | 3/2001 | Stearns et al. | 482/52 |
| 6,206,804 B1 | | 3/2001 | Maresh | 482/52 |
| 6,210,305 B1 | | 4/2001 | Eschenbach | 482/52 |
| 6,217,485 B1 | | 4/2001 | Maresh | 482/52 |
| 6,248,045 B1 | | 6/2001 | Stearns et al. | 482/52 |
| 6,334,836 B1 | * | 1/2002 | Segasby | 482/4 |

(Continued)

FOREIGN PATENT DOCUMENTS

DE 198 42 490 A1 3/2000

*Primary Examiner*—Steve R Crow
(74) *Attorney, Agent, or Firm*—Terence P. O'Brien; Todd A. Rathe; Paul E. Schaafsma

(57) ABSTRACT

An exercise device is provided including a foot link having a rearward end and a forward end. An adjustable stride mechanism is provided. The adjustable stride mechanism includes a primary gear and a secondary gear. The primary gear is sized larger relative to the secondary gear. A primary crank connects the primary gear and the secondary gear. A timing belt connects the primary gear to the secondary gear. The primary crank and the timing belt enable the secondary gear to rotate around the primary gear. A secondary crank is pivotally attached to the secondary gear and to a foot link. The secondary crank creates an ellipse-shaped path for the foot link as the secondary gear rotates around the primary gear. Thus, the foot link motion combines an at least a dual ellipse motion. An automatic adjusting mechanism can be provided to adjust the adjustable stride mechanism.

40 Claims, 9 Drawing Sheets

U.S. PATENT DOCUMENTS

| | | | | |
|---|---|---|---|---|
| 6,338,698 | B1 | 1/2002 | Stearns et al. | 482/52 |
| 6,361,476 | B1 * | 3/2002 | Eschenbach | 482/52 |
| 6,409,632 | B1 | 6/2002 | Eschenbach | 482/52 |
| 6,422,977 | B1 | 7/2002 | Eschenbach | 482/52 |
| 6,436,007 | B1 | 8/2002 | Eschenbach | 482/52 |
| 6,440,042 | B2 | 8/2002 | Eschenbach | 482/52 |
| 6,482,132 | B2 | 11/2002 | Eschenbach | 482/52 |
| 6,551,218 | B2 | 4/2003 | Goh | 482/52 |
| 7,270,626 | B2 * | 9/2007 | Porth | 482/52 |
| 7,361,122 | B2 * | 4/2008 | Porth | 482/52 |
| 2001/0036886 | A1 | 11/2001 | Eschenbach | 482/142 |
| 2001/0056010 | A1 | 12/2001 | Stearns et al. | 482/52 |
| 2002/0019298 | A1 | 2/2002 | Eschenbach | 482/51 |
| 2002/0055420 | A1 | 5/2002 | Stearns et al. | 482/52 |
| 2002/0142890 | A1 | 10/2002 | Ohrt et al. | 482/52 |
| 2002/0151411 | A1 | 10/2002 | Stearns et al. | 482/52 |
| 2002/0198083 | A1 | 12/2002 | Goh | 482/57 |
| 2003/0092532 | A1 | 5/2003 | Giannelli et al. | 482/51 |

* cited by examiner

FIG. 9
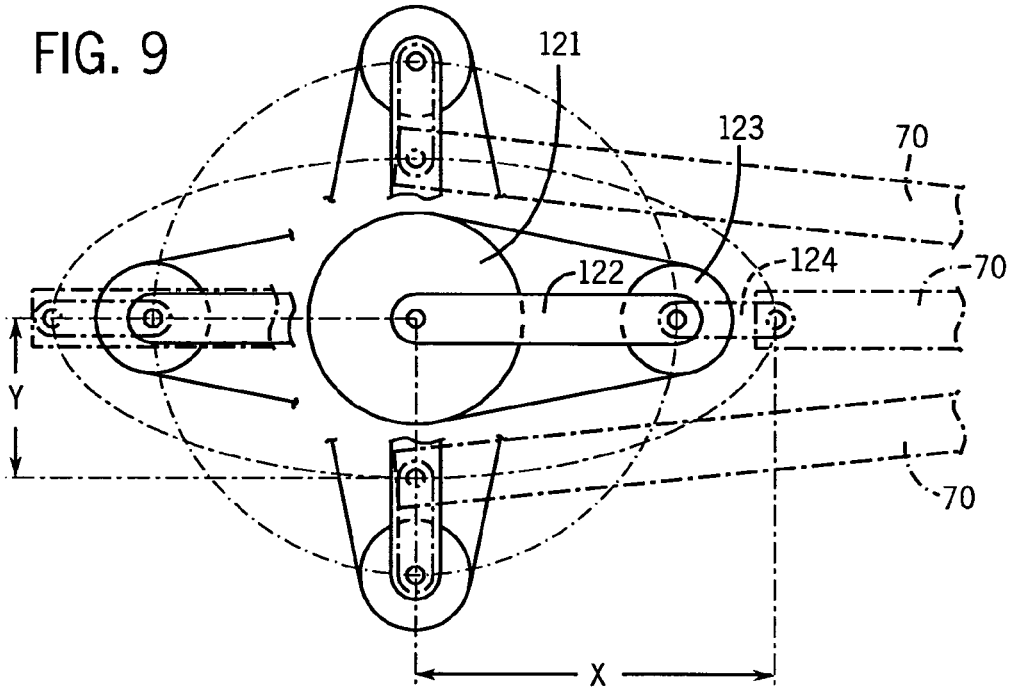
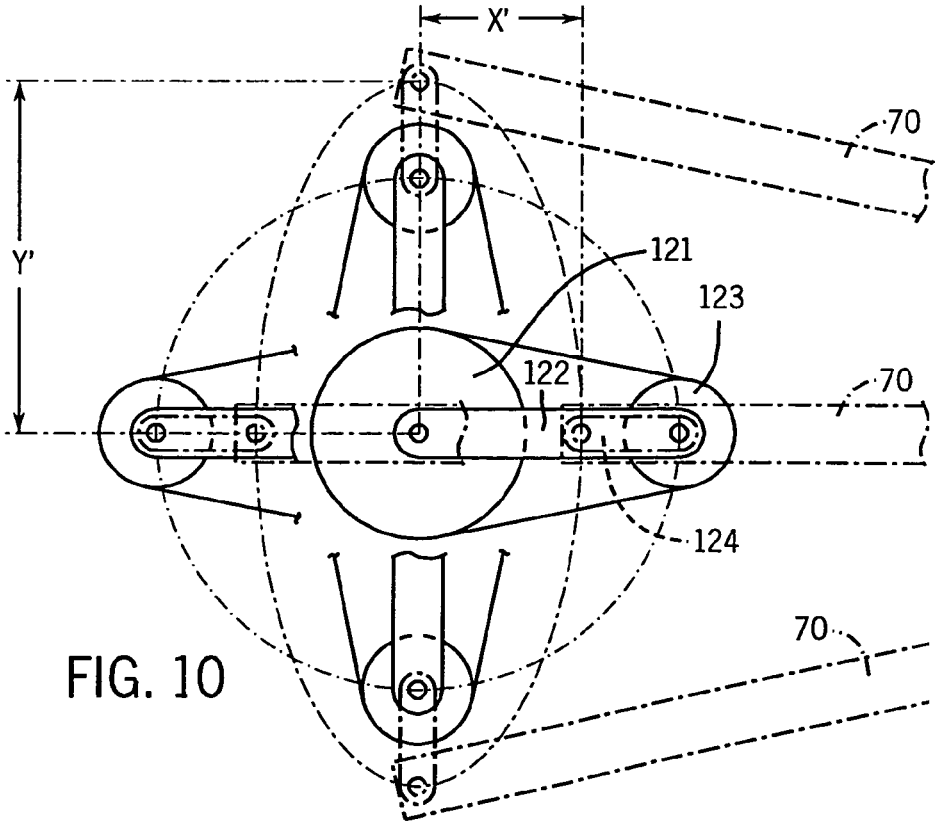
FIG. 10

ELLIPTICAL EXERCISE EQUIPMENT WITH ADJUSTABLE STRIDE

FIELD OF THE INVENTION

The present invention relates to exercise equipment.

BACKGROUND OF THE INVENTION

The benefits of regular aerobic exercise are well established. However, due to time constraints, inclement weather, and other reasons, many people are prevented from aerobic activities such as walking, jogging, running, and swimming. In response, a variety of exercise equipment has been developed for aerobic activity. It is generally desirable to exercise a large number of different muscles over a significantly large range of motion so as to provide for balanced physical development, to maximize muscle length and flexibility, and to achieve optimum levels of aerobic exercise. It is further advantageous for exercise equipment to provide smooth and natural motion, thus avoiding significant jarring and straining that can damage both muscles and joints.

While various exercise systems are known in the prior art, these systems suffer from a variety of shortcomings that limit their benefits and/or include unnecessary risks and undesirable features. For example, stationary bicycles are a popular exercise system in the prior art; however, these machines employ a sitting position that utilizes only a relatively small number of muscles, through a fairly limited range of motion. Cross-country skiing devices are also utilized to simulate the gliding motion of cross-country skiing. While cross-country skiing devices exercise more muscles than stationary bicycles, the substantially flat shuffling foot motion provided by the ski devices limits the range of motion of some of the muscles being exercised. Another type of exercise device simulates stair climbing. These devices exercise more muscles than stationary bicycles; however, the rather limited range of up-and-down motion utilized does not exercise the user's leg muscles through a large range of motion. Treadmills are still a further type of exercise device in the prior art. Treadmills allow natural walking or jogging motions in a relatively limited area. A drawback of the treadmill, however, is that significant jarring of the hip, knee, ankle and other joints of the body may occur through use of this device.

A further limitation of a majority of exercise systems in the prior art lies in the limits in the types of motions that they can produce. A relatively new class of exercise devices is capable of producing elliptical motion. Exercise systems create elliptical motion, as referred to herein, when the path traveled by a user's feet while using the exercise system follows an ellipse-shaped path of travel. Elliptical motion is much more natural and analogous to running, jogging, walking, etc., than the linear-type, back and forth motions produced by some prior art exercise equipment.

One drawback of exercise systems that create elliptical motion is that a user's feet are constrained to travel through a path that is substantially limited in terms of size and configuration from one user to the next. While some exercise devices of the prior art attempt to provide adjustable features, these attempts are crude and inconvenient to use.

What would thus be desirable is an exercise device that provides for smooth natural action, exercises a relatively large number of muscles through a large range of elliptical motion, and provides for safety and stability. Such an exercise device would further provide adjustable features that are convenient to use.

SUMMARY OF THE INVENTION

An exercise device in accordance with the principles of the present invention provides for smooth natural action, exercises a relatively large number of muscles through a large range of elliptical motion, employs arm, shoulder and rotational movement, and provides for safety and stability. An exercise device in accordance with the principles of the present invention provides adjustable features that are convenient to use.

An exercise device in accordance with the present invention includes a foot link having a rearward end and a forward end. An adjustable stride mechanism is provided. The adjustable stride mechanism includes a primary gear and a secondary gear. The primary gear is sized larger relative to the secondary gear. A primary crank connects the primary gear and the secondary gear. A timing belt connects the primary gear to the secondary gear. The primary crank and the timing belt enable the secondary gear to rotate around the primary gear. A secondary crank is pivotally attached to the secondary gear and to a foot link. The secondary crank creates an elliptical shaped path for the rearward end of the foot link and a central region of the foot link as the secondary gear rotates around the primary gear. Thus, the foot link motion combines an at least a dual elliptical motion. An automatic adjusting mechanism can be provided to adjust the adjustable stride mechanism.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein:

FIG. 9 is a schematic depicting one paths of the adjustable stride elliptical mechanism of FIG. 7.

FIG. 10 is a schematic depicting another paths of the adjustable stride elliptical mechanism of FIG. 7.

DETAILED DESCRIPTION OF THE INVENTION

While an exemplary embodiment of the invention has been illustrated and described, it will be appreciated that various changes can be made therein without departing from the spirit and scope of the invention.

Figure 1:
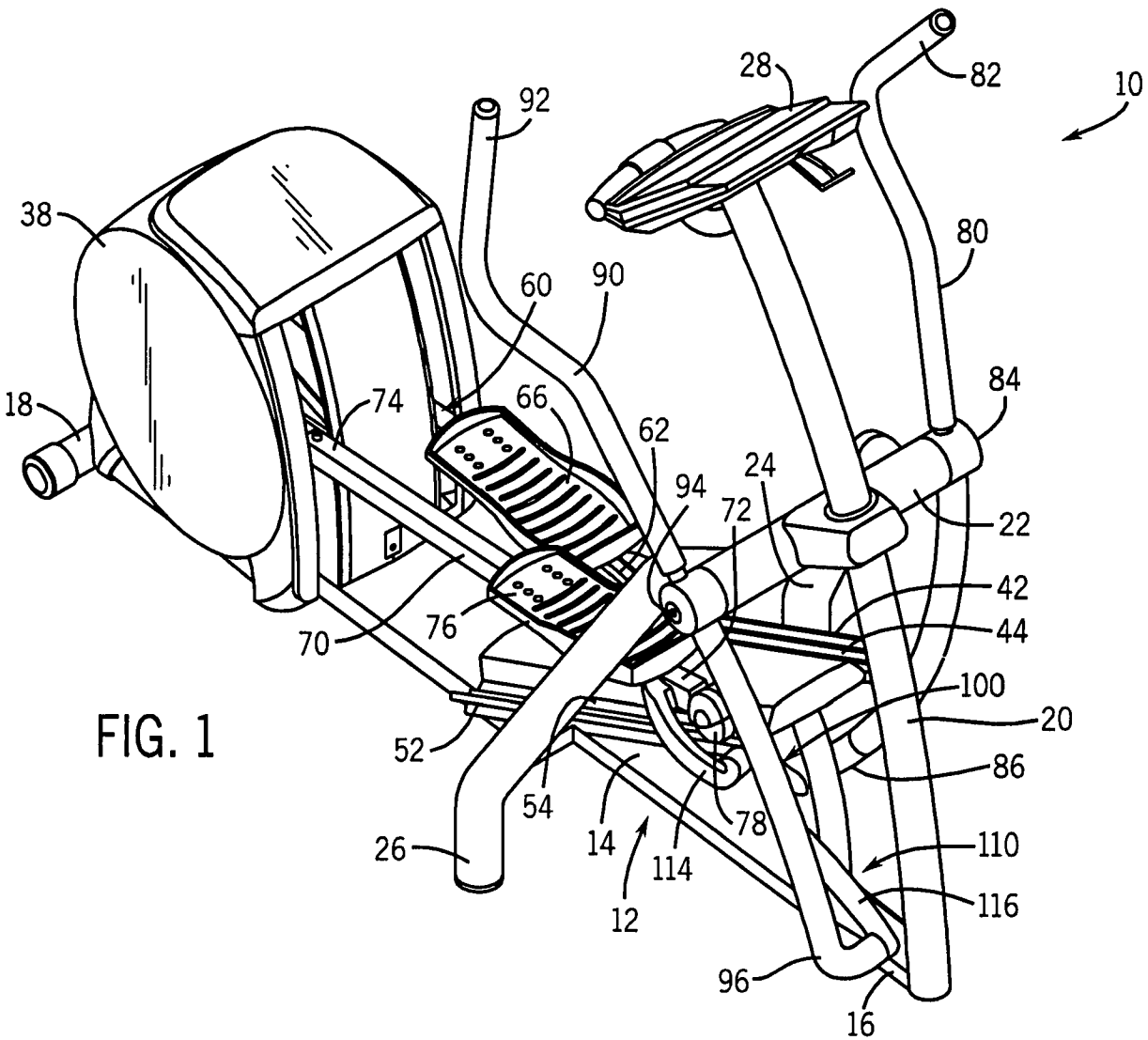
FIG. 1 illustrates an elevated front perspective view of an exercise device in accordance with the principles of the present invention.
Figure 2:
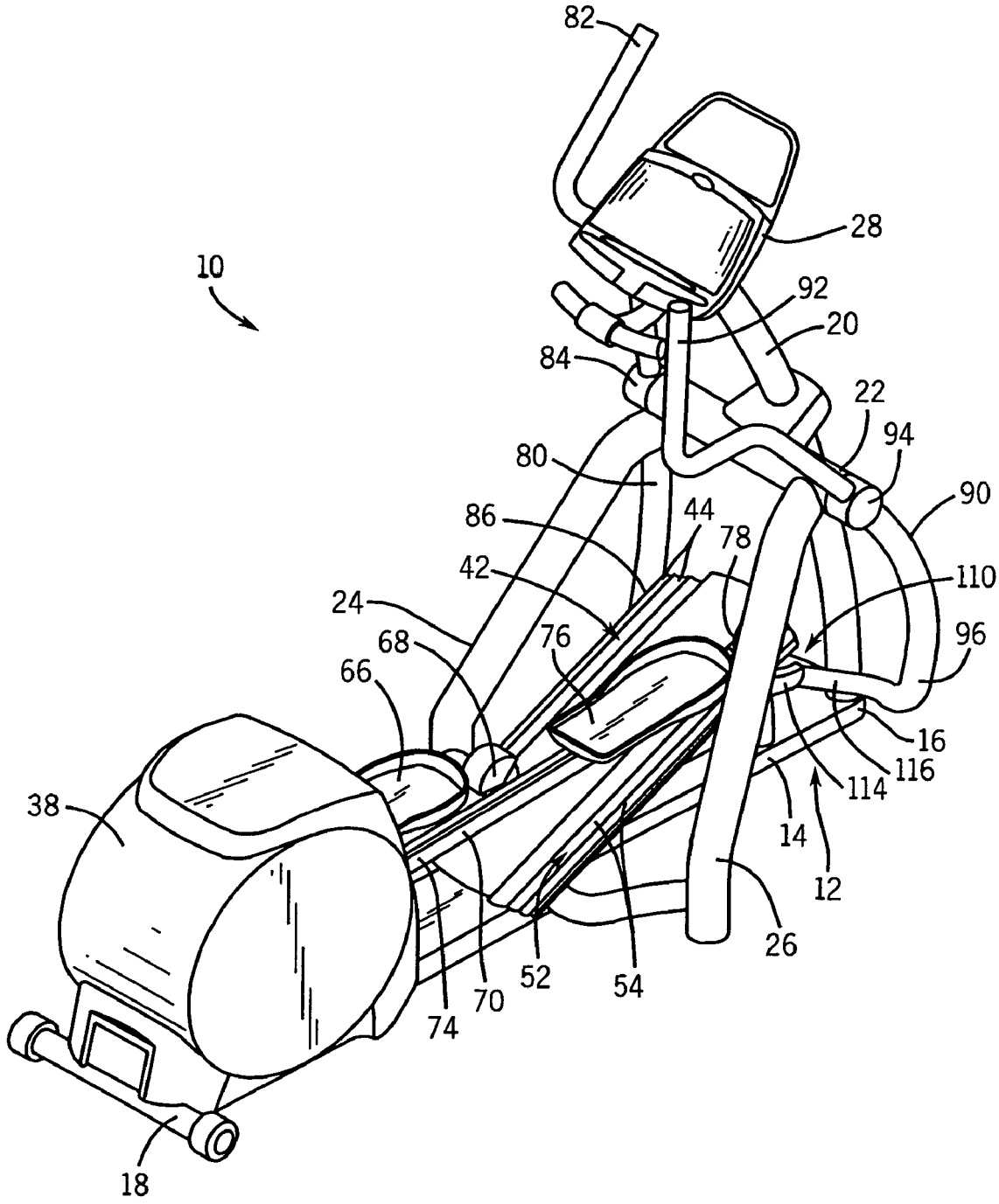
FIG. 2 illustrates an elevated rear perspective view of the exercise device of FIG. 1.
Figure 3:
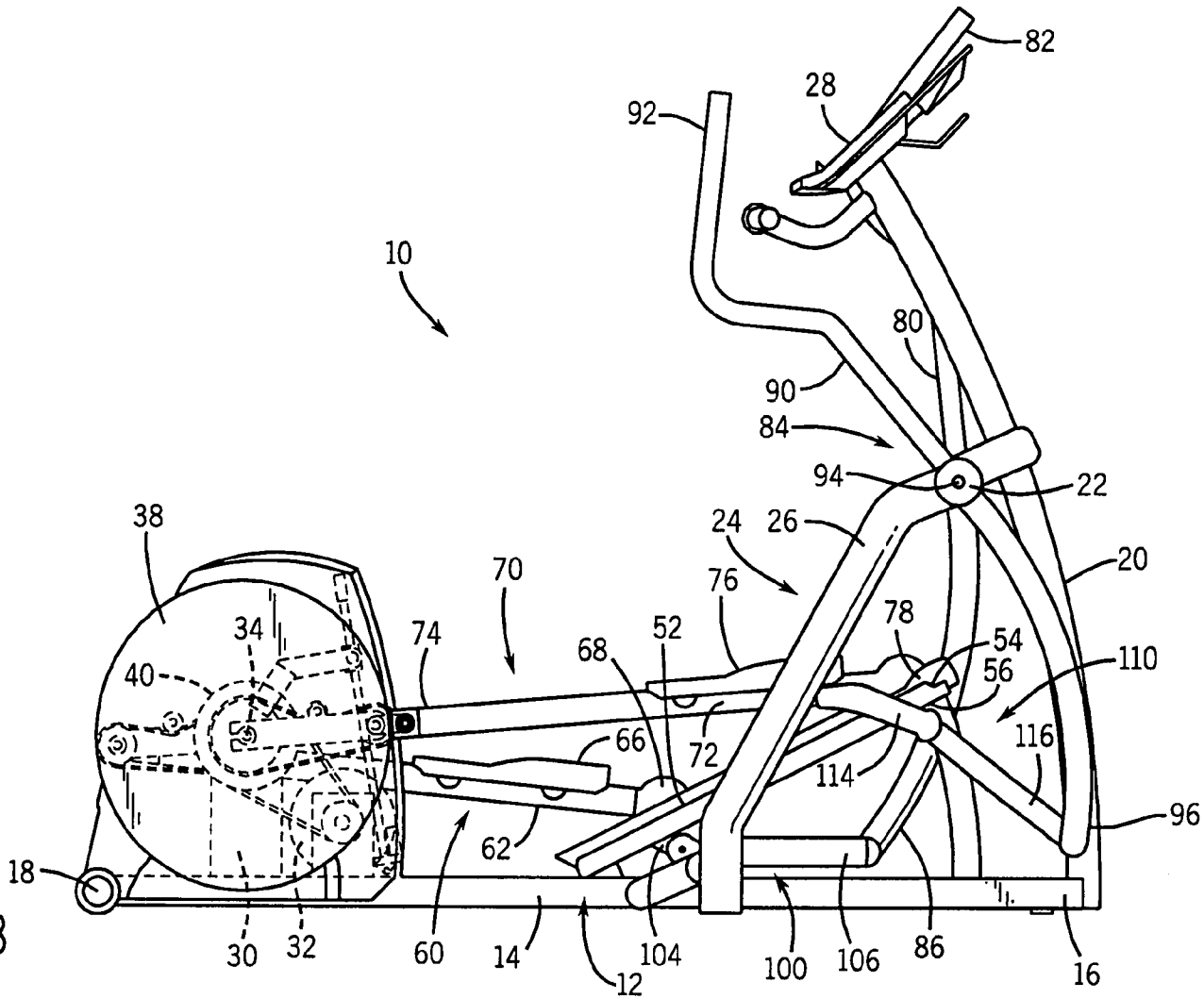
FIG. 3 illustrates a side view of the exercise device of FIG. 1.

FIGS. 1-3 illustrate an embodiment of an exercise device 10 constructed in accordance with the principles of the present invention that exercises both the upper and lower body in associated motion. Briefly described, the exerciser 10 includes a frame 12 that has a forward upright member 20. The forward upright member 20 extends upwardly and curves slightly rearward from a substantially horizontal, longitudinal central member 14 of the frame 12. A center housing 38 is provided near the rear region of the frame 12. Center housing 38 is described in detail below with respect to FIGS. 7-11. Left and right foot links 60, 70 each include a forward portion 62, 72, a rearward portion 64, 74, and a foot support portion 66, 76 there between. The rearward portions 64, 74 of the foot links 60, 70 extend into the center housing 38 as described in detail below such that the foot support portion 66, 76 of the foot links travel in an elliptical path.

The forward portions 62, 72 of the foot links 60, 70 preferably are supported by rollers 68, 78, which engage guide tracks 42, 52 that are mounted to the frame 12. In one embodiment of the present invention, the guide tracks can be statically mounted to the frame 12. In an alternative embodiment, the guide tracks can incorporate a mechanism such as a motor (not shown) and a lead screw (not shown) for selectively adjusting the inclination of the guide tracks. The forward portions 62, 72 of the foot links 60, 70 are operatively connected to engagement assemblies 100, 110, which in turn are operatively connected to the coupling regions 86, 96 of left and right swing arm mechanisms 80, 90, respectively. The swing arm mechanisms 80, 90 are rotatably connected to the forward upright member 20 of the frame 12 at their respective pivot points 84, 94. The swing arm mechanisms 80, 90 further contain left and right hand-gripping portions 82, 92. Each engagement assembly 100, 110 includes an abutment arm 106, 116, and a curved attachment link 104, 114, which together prevent the derailment of the foot link rollers 68, 78 from the guide tracks 42, 52.

More particularly, the frame 12 includes the longitudinal central member 14 that terminates at forward and rearward portions 16, 18. Preferably, the forward portion 16 of the frame 12 simply terminates at the end of the longitudinal central member 14, while the rearward portion 18 terminates as a relatively shorter transverse member. Alternatively, other frame configurations can be employed including, for example, a shorter transverse member being positioned at forward portion of the frame as well. Ideally, but not essentially, the frame 12 is composed of tubular members that are relatively light in weight but that provide substantial strength and rigidity. The frame 12 may also be composed of solid members that provide the requisite strength and rigidity while maintaining a relatively lightweight.

The forward upright member 20 extends upwardly and slightly rearward from the forward portion 16 of the floor-engaging frame 12. Preferably, the upright member 20 is slightly rearward curved; however, the forward member 20 may be configured at other upward angles without departing from the scope of the present invention. A relatively short, transversely oriented crossbar member 22 is connected to the forward upright member 20. Left and right balance arms 24, 26 can depend downwardly from each end of the crossbar member 22 to engage the floor on each side of the longitudinal central member 14 near the forward portion of the exercise device 10, thereby increasing stability. Ideally, but not essentially, these members are composed of a material similar to that described above, and are formed in quasi-circular tubular configurations.

Preferably, a view screen 28 is securely connected to the upper portion of the forward upright member 20, at an orientation that is easily viewable to a user of the device 10. Instructions for operating the device as well as courses being traveled may be located on the view screen 24 in an exemplary embodiment. In some embodiments of the present invention, electronic devices may be incorporated into the exerciser device 10 such as timers, odometers, speedometers, heart rate indicators, energy expenditure recorders, controllers, etc. This information may be routed to the view screen 28 for ease of viewing for a user of the device 10.

The elliptical motion exerciser 10 further contains longitudinally extending left and right foot links 60, 70. As shown in FIGS. 1-3, the foot links 60, 70 are illustrated in the shape of elongated, relatively thin beams. The foot links 60, 70 are aligned in approximately parallel relationship with the longitudinal central member 14 of the frame 12. The foot support portions 66, 76 are positioned near the forward portions of the foot links 60, 70, and provide stable foot placement locations for the user of the device. Alternatively, the foot support portions can be positioned at any location between the front and rear ends of the foot link. In some exemplary embodiments the foot support portions 66, 76 are configured to form toe straps and/or toe and heel cups (not shown) which aid in forward motion recovery at the end of a rearward or forward striding motion of a user's foot.

Figure 4:
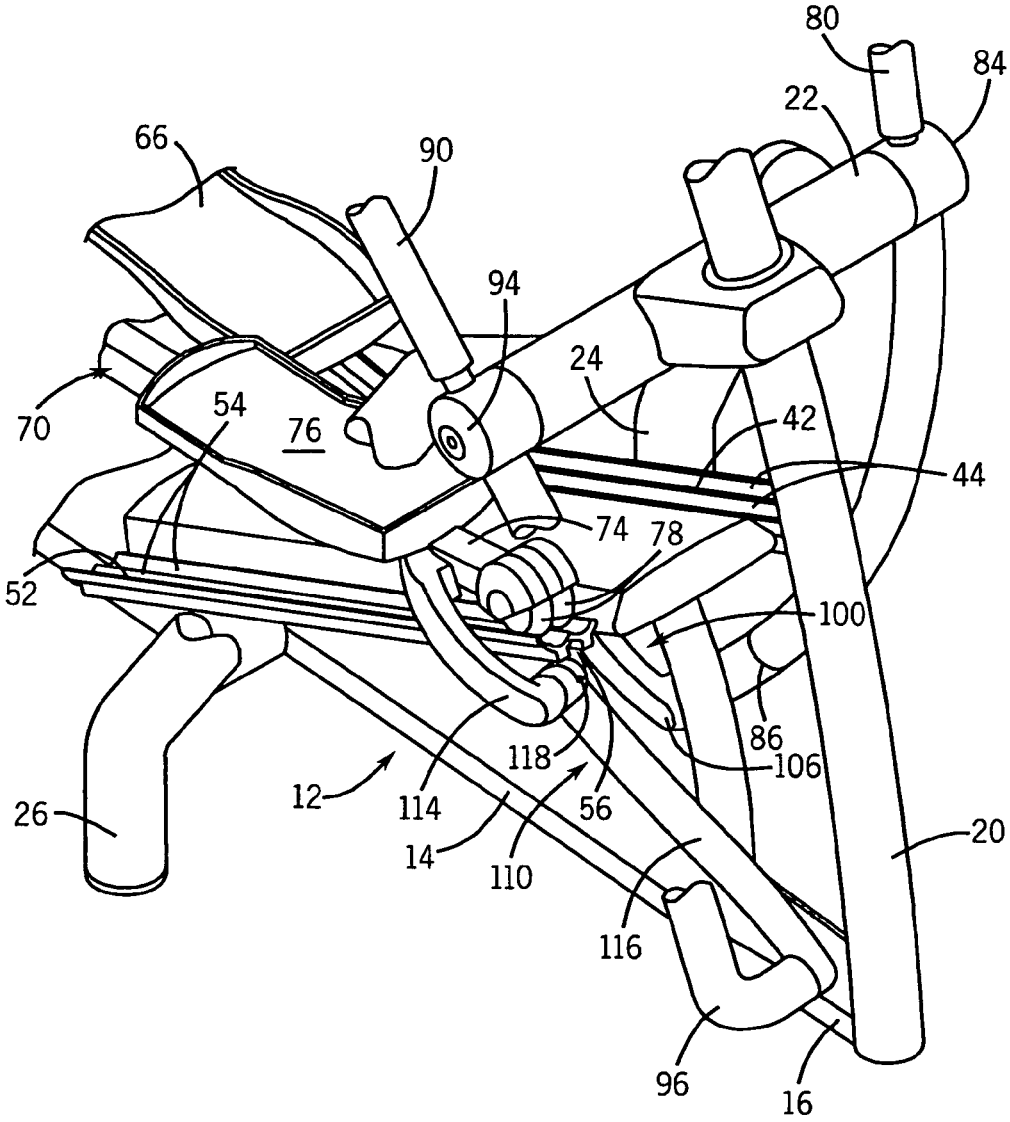
FIG. 4 illustrates a close-up perspective view of a portion of the exercise device of FIG. 1 that includes the abutment arm and curved attachment link of the engagement assembly.
Figure 5:
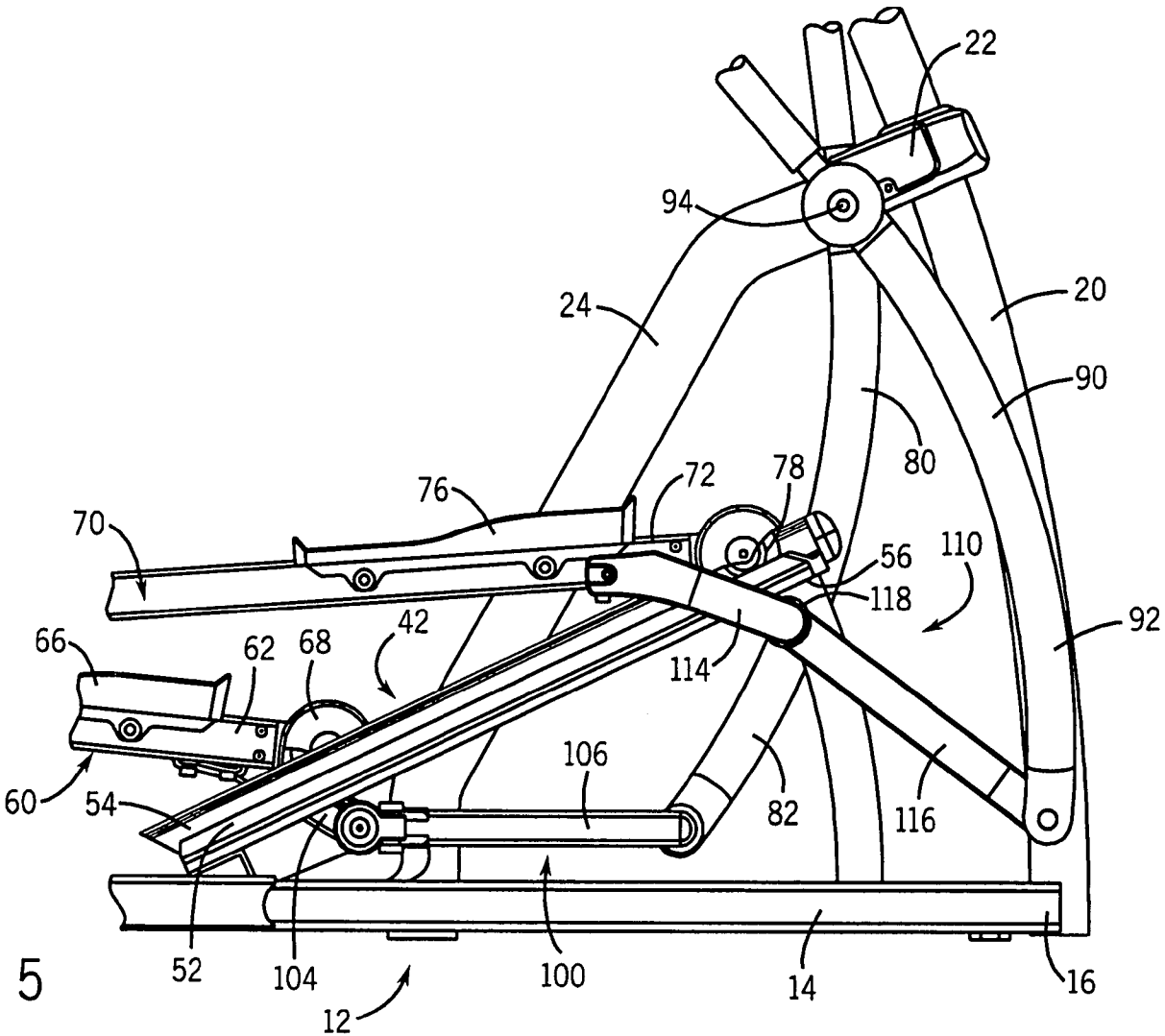
FIG. 5 illustrates a close-up side view of the exercise device of FIG. 1 that includes the abutment arm and curved attachment link of the engagement assembly.

As most clearly shown in FIGS. 4-5, the exerciser device 10 further contains left and right guide tracks 42, 52. The guide tracks 42, 52 can be completely separate members, or can be part of one single connected unit (as shown in FIGS. 4 and 5). The guide tracks 42, 52 attach to the longitudinal central member 14 of the frame 12 at an angled inclination. In one embodiment, the angle of inclination is approximately 30 degrees. In one embodiment, the guide tracks 42, 52 can be connected to a height adjustment mechanism that can raise and lower the guide tracks 42, 52 thereby adjusting the angle of inclination Preferably, the upper surface of the guide tracks 42, 52 is shaped to contain two longitudinally extending, adjacent engagement grooves 44, 54. These engagement grooves 44, 54 give the upper surface of the guide tracks 42, 52 a generally "W-shaped" cross-sectional configuration. The engagement grooves 44, 54 are specifically sized and shaped to correspondingly mate with the rollers 68, 78 of the foot links 60, 70 in order to assist in the lateral containment of the rollers 68, 78 on the guide tracks. In addition, the lower surface of the guide tracks 42, 52 preferably contain longitudinally extending stabilizing troughs 56 (see FIG. 4).

The left and right forward portions 62, 72 of the foot links 60, 70 terminate in left and right engagement rollers 68, 78. The left and right engagement rollers 68, 78 ride along the above-described grooves 44, 54 of the guide tracks 42, 52. Preferably, the engagement rollers 68, 78 are actually pairs of rollers. The engagement rollers 68, 78 rotate about axles that are affixed to the forward portions 62, 72 of the foot links 60, 70. During use of the exercise device 10, the engagement rollers 68, 78 at the front of the foot links 60, 70 translate back and forth the length of the guide tracks 42, 52 in rolling engagement within the grooves 44, 54, as the foot support portions 66, 76 of the foot links 60, 70 travel in an elliptical path of motion, and the rearward portions 64, 74 of the foot links 60, 70 rotate about a transverse axle 34. In an alternate embodiment of the present invention, the engagement rollers 68, 78 could be replaced with sliding engagement mechanisms without departing from the scope of the present invention.

As shown in FIGS. 4-5, left and right engagement assemblies 100, 110 operatively connect the forward portions 62, 72 of the foot links 60, 70 to the coupling regions 86, 96 of swing arm mechanisms 80, 90. Preferably, each of the engagement assemblies 100, 110 includes a curved attachment link 104, 114, and an abutment arm 106, 116. In alternate embodiments, either more or fewer members can be utilized to produce the engagement assemblies 100, 110 without departing from the scope of the present invention. In an exemplary embodiment, the abutment arms 106, 116 each have an abutment knob 118. The abutment knobs 108, 118 are designed to withstand intermittent contact with the stabilizing troughs 56 on the lower surface of the guide tracks 42, 52 during use of the exercise device 10.

In alternate embodiments of the present invention, the engagement assemblies 100, 110 could be configured such that the abutment knobs 118 were located on the curved attachment links 104, 114 (or the abutment knobs could be deleted altogether), without departing from the scope of the present invention. Further, depending on the exact configuration and number of links utilized in the engagement assemblies 100, 110, the curved attachment links 104, 114 may not even be curved, but rather may be linear attachment links. Each curved attachment link 104, 114 is rotatably coupled to an abutment arm 106, 116. Each curved attachment link 104, 114 is fixedly secured to the forward portion 62, 72 of a foot link 60, 70, and each abutment arm 106, 116 is rotatably coupled to the coupling region 86, 96 of a swing arm mechanism 80, 90.

Referring again to FIGS. 1-3, the exerciser device 10 contains left and right swing arm mechanisms 80, 90. Respectively, each swing arm mechanism 80, 90 contains a hand-gripping portion 82, 92, a pivot point 84, 94, and a coupling region 86, 96. The coupling regions 86, 96 of the swing arm mechanisms 80, 90 rotatably connect to the engagement assemblies 100, 110, and turn to the foot support portions 66, 76 of the foot links 60, 70. The pivot points 84, 94 rotatably secure the swing arm mechanisms 80, 90 to each end of the crossbar member 22 of the frame 12.

The hand-gripping portions 82, 92 of the swing arm mechanisms 80, 90 are grasped by the hands of the individual user, and allow upper body arm and shoulder exercising motions to be incorporated in conjunction with the reciprocal, elliptical exercising motion traced out by the feet of the user. As can be more readily understood with reference to FIGS. 1-3, the linking of the swing arm mechanisms 80, 90 to the foot links 60, 70, via the engagement assemblies 100, 110, and the rotational securement of the swing arm mechanisms 80, 90 to the forward upright member 20 of the frame 12 at the pivot points 84, 94, results in generally rearward, elliptical motion of a hand-gripping portion being correspondingly linked to a generally forward, elliptical motion of a respective foot support portion, and vice versa.

Figure 6:
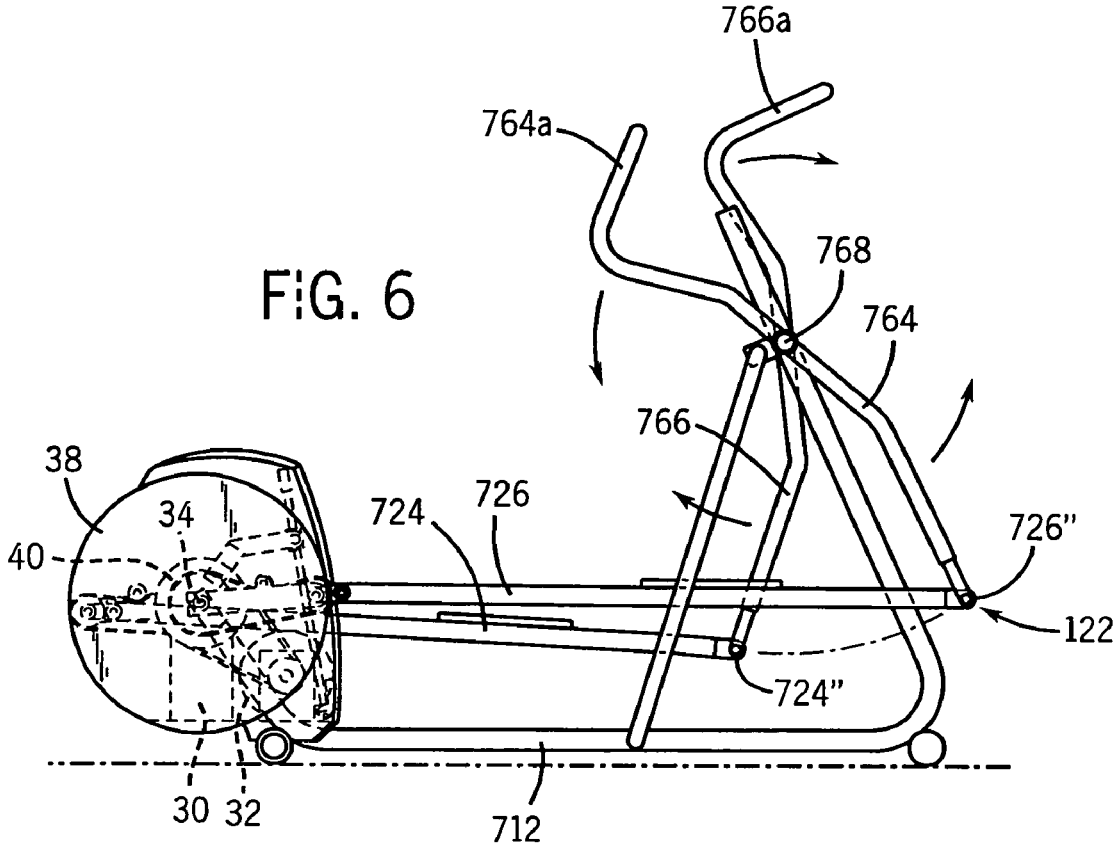
FIG. 6 illustrates an elevated side view of an alternative exercise device in accordance with the principles of the present invention.

An alternative exemplary exercise device that can incorporate the principles of the present invention is set forth in FIG. 6. The exercise device includes a frame 712 with a center housing 38 provided near the rear region of the frame 712. First and second foot links, 724, 726 are provided. The foot links 724, 726 are generally elongated members having a first portion pivotally connected within center housing 38 in such a manner so as to permit travel of the first ends of the foot links 724 and 726 in an elliptical path of travel. A pair of arm links 764 and 766 are provided. Each arm link 764, 766 is pivotally supported by the frame 712 at support point 768. The arm links 764, 766 are also pivotally coupled to the ends 724", 726" of the foot links 724, 726. Pivoting of the arm links 764, 766 about the support point 768 causes the second ends 724", 726" of the foot links 724, 726 to reciprocate along a curved path. The arm links 764, 766 also include handle portions 764*a*, 766*a* associated therewith. These handle portions may be configured to be gripped by a user and, during the operation of the device they also reciprocate, thereby providing upper body exercise.

Referring back to FIG. 3, an axle mount 30 is located toward the rearward portion 18 of the frame 12. The axle mount 30 is attached to the frame 12 and extends approximately upward from the substantially horizontal, longitudinal central member 14. The transverse axle 34 is rotatably housed in the upper region of the axle mount 30. The regions of the axle mount 30 which house the ends of the transverse axle 34 contain low friction engaging systems (not shown), such as bearing systems, to allow the transverse axle 34 to rotate with little resistance within the housing in the axle mount 30. The transverse axle 34 can be operatively coupled to a flywheel 40 contained within the center housing 38. The present invention further can include a brake system 32, such as for example an eddy current brake assembly. The brake system 32 can selectively apply a braking or retarding force on the rotation of the flywheel 40 via a drive belt 33 (FIG. 7).

Figure 7:
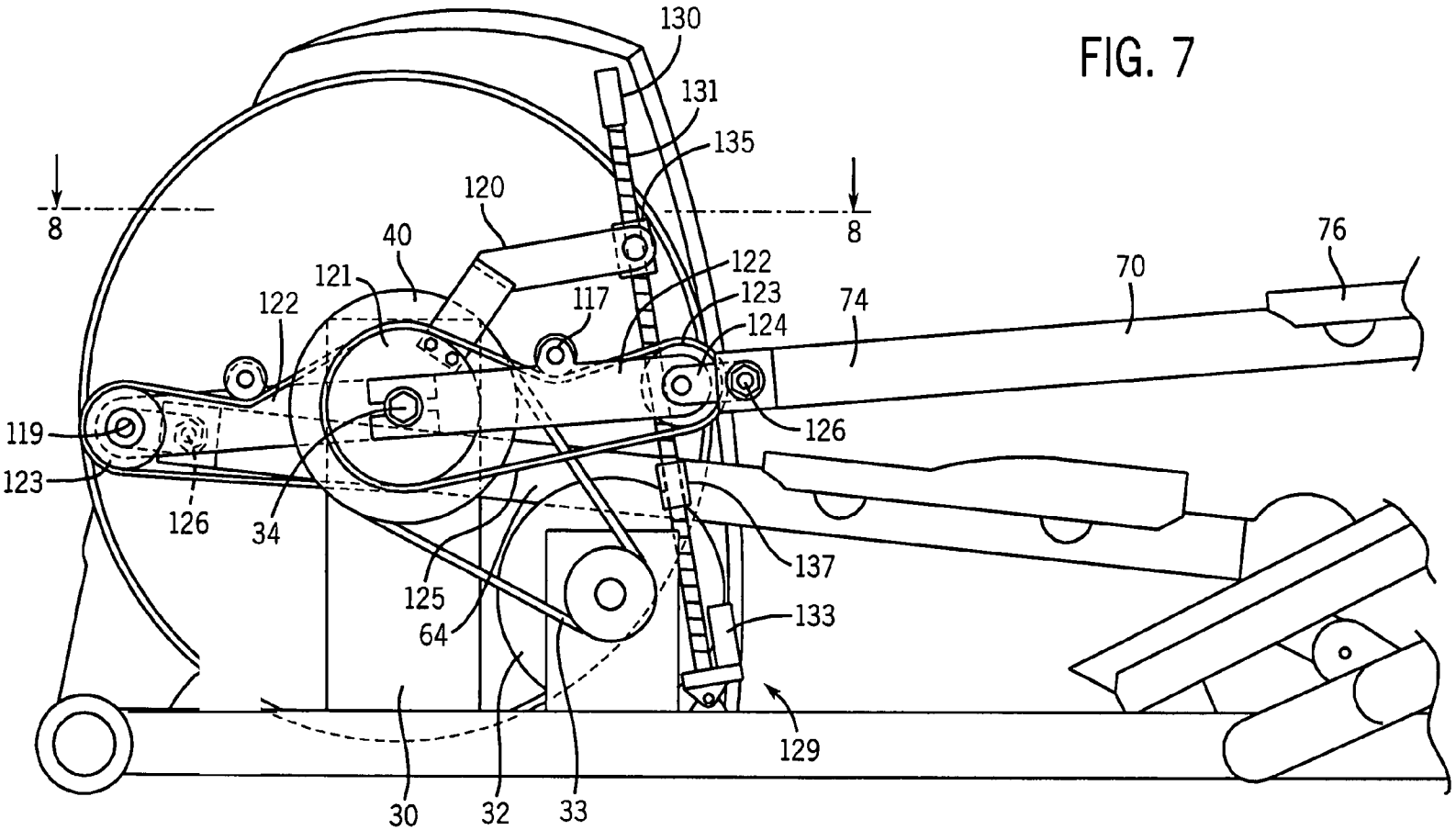
FIG. 7 is an adjustable stride elliptical mechanism in accordance with the principles of the present invention.

Referring now to FIG. 7, an adjustable stride elliptical mechanism in accordance with the principles of the present invention is seen. A primary gear 121 and a secondary gear 123 are provided. The primary gear 121 is eke sized larger relative to the secondary gear 123. The secondary gear 123 is connected to the outboard end of crank 122 and is free to rotate as defined by the timing belt and primary gear 121. A primary crank 122 connects the axis of the primary gear 121 and the secondary gear 123. A timing belt 125 is provided connecting primary gear 121 to secondary gear 123. The primary crank 122 and the timing belt 125 allow the secondary gear 123 to rotate around primary gear 121 in a circular path created by the primary crank 122, about the central axis of the primary gear 121. In alternative embodiments, alternative mechanisms can be substituted for the mechanisms of the preferred embodiment including but not limited to a cam mechanisms, alternative belt and gear mechanisms, chain mechanisms, etc.

The size ratio between the primary gear 121 and secondary gear 123 is such that the secondary gear 123 rotates about its own axis twice per one revolution around primary gear 121. A secondary crank 124 is pivotally attached to the secondary gear 123. The secondary crank 124 is pivotally attached to the rearward end 74 of the foot link 70 and thus controls the movement of the foot link. As the secondary gear 123 rotates around the primary gear 121 the secondary crank 124 rotates around the secondary gear 124.

Figure 8:
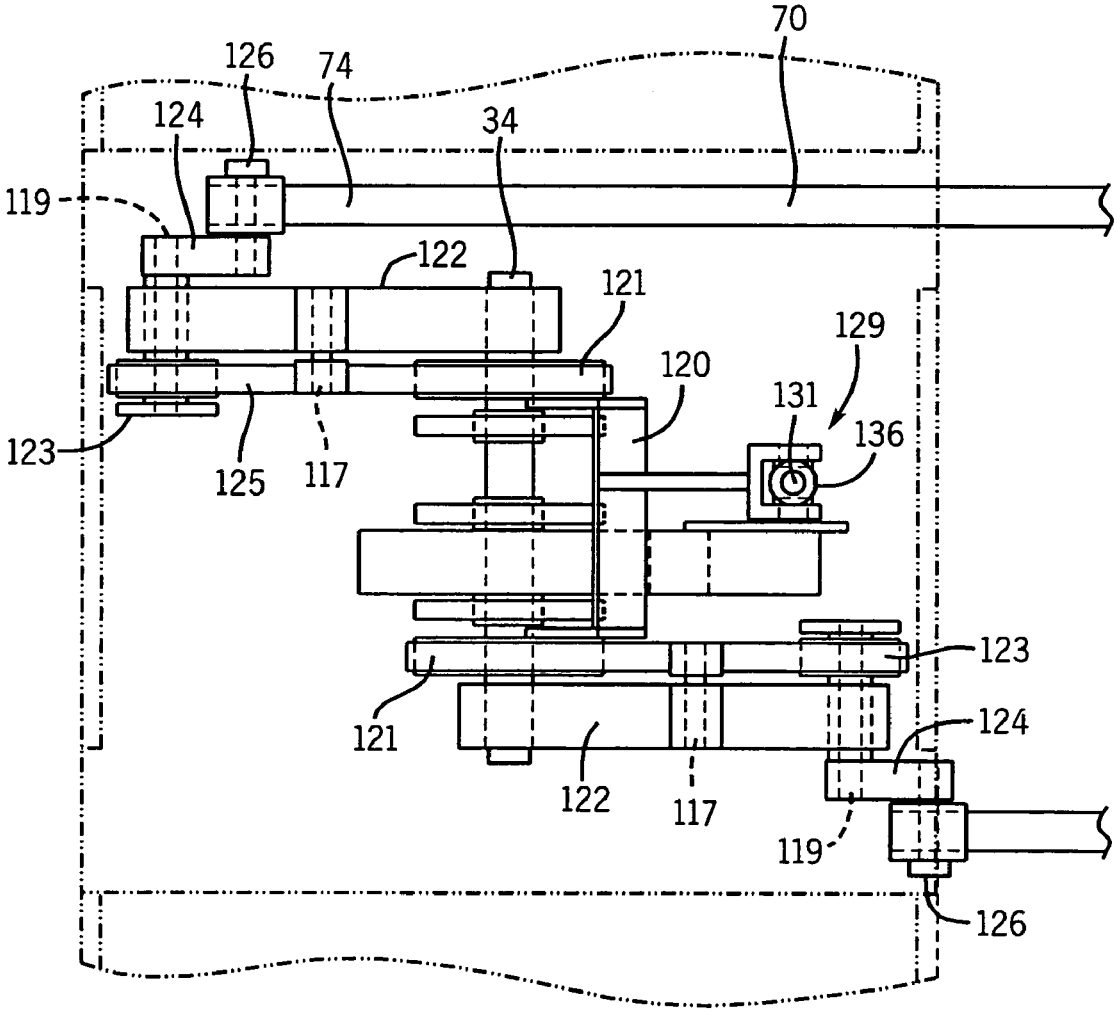
FIG. 8 shows a top view of the adjustable stride elliptical mechanism of FIG. 7.

The primary gear 121 is secured on a support bracket 120. The support bracket 120 is best seen in FIG. 8, which shows a top view of the adjustable stride elliptical mechanism of FIG. 7. The support bracket 120 is secured at the end opposite the primary gear 121 to an adjusting mechanism 129 (FIG. 7). In one embodiment, the adjusting mechanism 129 can include a rotatable threaded member 131 operatively connected to an electronic motor 133 to impart rotation thereon. Secured to the support bracket 120 at a hinged connection is a threaded bolt follower 135. The threaded bolt follower 135 is cooperatively engaged to the rotatable threaded member 131. The rotatable threaded member 131 includes an upper stop 135 and a lower stop 137. By activating the electronic motor 133 and imparting rotational movement on the rotatable threaded member 131, the threaded bolt follower 135 rises or falls on the rotatable threaded member 131. As the threaded bolt follower 131 rises or falls, the support bracket 120 is pivoted upwardly or downwardly. As the support bracket 120 is pivoted upwardly or downwardly, the primary gear 121 is rotated relative to the secondary gear 123, thereby adjusting the clocking or the angular orientation of the crank 124 relative to the crank arm 122.

In a preferred embodiment, the adjusting mechanism can be automatically adjusted by the user. In one embodiment, electronics connect the electronic motor 133 to the view screen 28 such that the user can control the adjusting mechanism via the view screen. The adjusting mechanism can incorporate a sensing system to sense the extension and retraction of the adjusting mechanism, and thus, the angle of inclination of the adjusting mechanism with respect to the frame or the ground. The angle of inclination of the adjusting mechanism can be transmitted to a CPU through an analog to digital interface and controller.

Thus, depending on the orientation of primary gear 121 with respect to the secondary gear 123, the secondary crank 124 proceeds in different shaped paths thereby imparting different paths on the foot link 70. Referring to FIGS. 9 and 10, schematics depicting different paths of the adjustable stride elliptical mechanism are seen. In a first orientation seen in FIG. 9, the orientation of the primary gear 121 and the secondary gear 123 have been adjusted such that the secondary crank 124 extends outwardly relative to the primary crank 122 at the horizontal apex and inwardly at the vertical apex of the path. In this path, the user is presented with a relatively more horizontally skewed elliptical path.

In a second orientation seen in FIG. 10, the orientation of the primary gear 121 and the secondary gear 123 have been adjusted such that the secondary crank 124 extends inwardly relative to the primary crank 122 at the horizontal apex and outwardly at the vertical apex of the path. In this path, the user is presented with a relatively more vertically skewed elliptical path. Of course, depending on the orientation of the primary gear 121 with the secondary gear 123 as controlled by the automatic adjusting mechanism 129, a nearly infinite number of paths can be selected by the user.

To use the present invention, the user stands on the foot support portions 66, 76 and grasps the hand-gripping portions 82, 92. The user imparts a rearward stepping motion on one of the foot support portions and a forward stepping motion on the other foot support portion, thereby causing the transverse axle 34 to rotate in a clockwise direction (when viewed from the right side as shown in FIG. 1), due to the crank arm assemblies 122, 124 coupling the motion of the foot links 60, 70 to the rotation of the transverse axle 34. In conjunction with the lower body action, the user also imparts a substantially forward pushing motion on one of the hand-gripping portions 82, 92 and a substantially rearward pulling motion on the other hand-gripping portion 82, 92. Due to the rotatable connection of the coupling regions 86, 96 of the swing arm mechanisms 80, 90 to the forward ends 62, 72 of the foot links 60, 70 (via the engagement assemblies), and the rotational securement of the swing arm mechanisms 80, 90 to the forward upright member 20 of the frame 12 at their pivot points 84, 94, each hand-gripping portion 82, 92 moves forward as its respective foot support portion moves rearward, and vice versa.

One of the advantages of the present invention is that, to adjust the elliptical path in accordance with the invention, the user need not step off the exercise device or indeed, even stop or disrupt the exercise routine. Thus, the user can simply activate the automatic adjusting mechanism from the view screen during an exercise routine.

The foot links 60, 70 are attached to the transverse axle 34 by the crank arm assemblies 122, 124 such that one foot support portion moves substantially forward as the other foot support portion moves substantially rearward. In this same fashion one hand-gripping portion moves forward as the other hand-gripping portion moves rearward (e.g., when the left hand-gripping portion 82 moves forward, the left foot support portion 66 moves rearward, while the right foot support portion 76 moves forward and the right hand-gripping portion 92 moves rearward). Therefore, the user can begin movement of the entire foot link and swing arm mechanism linkage by moving any foot support portion or hand-gripping portion, or preferably by moving all of them together.

While the invention has been described with specific embodiments, other alternatives, modifications and variations will be apparent to those skilled in the art. For example, while the exemplary embodiment described herein describes the automatic adjusting mechanism as comprising an electronic motor that imparts rotation to a rotatable threaded member that in turn adjusts a support bracket rotating the primary gear relative to the secondary gear, alternative mechanisms including but not limited to a cam follower, a link arm and gears, a rack and pinion of other like structures can be employed. Accordingly, it will be intended to include all such alternatives, modifications and variations set forth within the spirit and scope of the appended claims.

What is claimed is:

1. An adjustable stride elliptical mechanism comprising:

a primary gear and a secondary gear, the primary gear sized larger relative to the secondary gear;

a primary crank connecting the primary gear and the secondary gear;

a timing belt connecting the primary gear to the secondary gear, the primary crank and the timing belt enabling the secondary gear to rotate around the primary gear;

a secondary crank pivotally attached to the secondary gear and to a foot link, the secondary crank creating a generally elliptical shaped path for the foot link as the secondary gear rotates around the primary gear; and an automatic adjusting mechanism adjusting the clocking of the secondary crank.

2. The adjustable stride elliptical mechanism of claim 1, further wherein the secondary gear rotates about its own axis twice per one revolution around primary gear.

3. The adjustable stride elliptical mechanism of claim 1, further wherein the automatic adjusting mechanism comprises a rotatable threaded member operatively connected to a electronic motor to impart rotation thereon and a threaded bolt follower cooperatively engaged to the rotatable threaded member and the primary gear.

4. The adjustable stride elliptical mechanism of claim 3, further wherein the primary gear is held by a support bracket and the support bracket is secured to the rotatable threaded member.

5. The adjustable stride elliptical mechanism of claim 1, further wherein the primary gear is held by a support bracket and the support bracket is secured to the automatic adjusting mechanism.

6. The adjustable stride elliptical mechanism of claim 1, further wherein the automatic adjusting mechanism rotates the primary gear relative to the secondary gear thereby adjusting the clocking of the secondary crank.

7. The adjustable stride elliptical mechanism of claim 1, further wherein the automatic adjusting mechanism can be effectuated by a user without the user interrupting exercise.

8. The adjustable stride elliptical mechanism of claim 7, further including a switch located proximal to the exercise area, the switch being operatively connected to the automatic adjusting mechanism such that the automatic adjusting mechanism can be effectuated by a user without the user interrupting exercise.

9. The adjustable stride elliptical mechanism of claim 1, further wherein the adjustable stride elliptical mechanism is held in a frame and further including a swing arm having a pivotal connection to the frame, the swing arm having an upper portion extending above the pivotal connection and a lower portion disposed below the pivotal connection.

10. An exercise device, comprising:

a foot link having a rearward end that is constrained to move in an orbital path and a forward end;

a swing arm having a pivotal connection to the frame, the swing arm having an upper portion extending above the pivotal connection and a lower portion disposed below the pivotal connection;

an adjustable stride mechanism for altering the orbital path of the rearward end of the foot link; and an automatic adjusting mechanism for adjusting the adjustable stride mechanism, wherein the adjustable stride mechanism comprises a primary gear and a secondary gear, and the automatic adjusting mechanism rotates the primary gear relative to the secondary gear.

11. The exercise device of claim 10, wherein the primary gear is sized larger relative to the secondary gear; a primary crank connecting the primary gear and the secondary gear; a timing belt connecting the primary gear to the secondary gear, the primary crank and the timing belt enabling the secondary gear to rotate around the primary gear; and a secondary crank pivotally attached to the secondary gear and to a foot link, the secondary crank creating a generally elliptical shaped path for the foot link as the secondary gear rotates around the primary gear.

12. The exercise device of claim 11, further wherein the secondary gear rotates about its own axis twice per one revolution around primary gear.

13. The exercise device of claim 12, further wherein the primary gear is held by a support bracket and the support bracket is secured to a rotatable threaded member.

14. The exercise device of claim 12, further wherein the primary gear is held by a support bracket and the support bracket is secured to the automatic adjusting mechanism.

15. The exercise device of claim 10, further wherein the automatic adjusting mechanism comprises a rotatable threaded member operatively connected to an electronic motor to impart rotation thereon and a threaded bolt follower cooperatively engaged to the rotatable threaded member and the adjustable stride mechanism.

16. The exercise device of claim 10, further wherein the automatic adjusting mechanism can be effectuated by a user without the user interrupting exercise.

17. The exercise device of claim 16, further including a switch located proximal to the exercise area, the switch being operatively connected to the automatic adjusting mechanism such that the automatic adjusting mechanism can be effectuated by a user without the user interrupting exercise.

18. The exercise device of claim 10, further including a left swing arm and right swing arm, a left foot link and right foot link, and a left engagement mechanism and right engagement mechanism.

19. The exercise device of claim 10 further including a guide track, wherein the foot link includes at least one roller, and the guide track has an upper surface that is adapted to rollably receive the foot link roller and that reciprocally engages the guide track.

20. The exercise device of claim 10 further comprising an electronic view screen attached to the exercise device for displaying exercise information.

21. The exercise device of claim 20, further wherein the electronic view screen displays information regarding the adjustable stride mechanism.

22. An exercise device, comprising:

a foot link having a rearward end that moves in a generally elliptical shaped path and a forward end;

a guide track adapted to receive reciprocal movement of the forward end of the foot;

wherein the foot link motion combines the ellipse-shaped path of the rearward end with an ellipse motion provided by the combination of the movement of the rearward end of the foot link and the reciprocal movement of the forward end of the foot link; and an adjustable stride mechanism for altering the generally elliptical shaped path of the rearward end of the foot link, wherein the adjustable stride mechanism comprises a primary gear and a secondary gear, the primary gear sized larger relative to the secondary gear; a primary crank connecting the primary gear and the secondary gear; a timing belt connecting the primary gear to the secondary gear, the primary crank and the timing belt enabling the secondary gear to rotate around the primary gear; and a secondary crank pivotally attached to the secondary gear and to a foot link, the secondary crank creating a generally elliptical shaped path for the foot link as the secondary gear rotates around the primary gear.

23. The exercise device of claim 22, further including an automatic adjusting mechanism adjusting the adjustable stride mechanism.

24. The exercise device of claim 23, further wherein the automatic adjusting mechanism can be effectuated by a user without the user interrupting exercise.

25. The exercise device of claim 23, further including a switch located proximal to the exercise area, the switch being operatively connected to the automatic adjusting mechanism such that the automatic adjusting mechanism can be effectuated by a user without the user interrupting exercise.

26. The exercise device of claim 22, further including a swing arm having a pivotal connection to the frame, the swing arm having an upper portion extending above the pivotal connection and a lower portion disposed below the pivotal connection.

27. The exercise device of claim 22 further wherein the foot link includes at least one roller, and the guide track has an upper surface that is adapted to rollably receive the foot link roller and that reciprocally engages the guide track.

28. A variable stride elliptical exercise device, comprising:

a frame having a pivot axis;

first and second foot links operably supported by the frame, each of the first and second foot links having a forward end and a rearward end;

an adjustable crank assembly rotatable about the pivot axis and coupled to the rearward end of the first and second foot links, the crank assembly including a primary gear and a secondary gear, the crank assembly positionable between at least a first position by rotation of the primary gear relative to the secondary gear, wherein the crank assembly positions the rearward ends of the first and second foot links in a generally vertical elliptical path of travel in the first position, and a second position by rotation of the primary gear relative to the secondary gear, wherein the crank assembly positions the rearward ends of the first and second foot links in a generally horizontal elliptical path of travel in the second position, wherein the adjustable crank assembly can be effectuated by a user without the user interrupting exercise.

29. The variable stride elliptical exercise device of claim 28, further comprising at least one guide track supported by the frame, wherein the forward end of the first and second foot links engage the at least one guide track.

30. The variable stride elliptical exercise device of claim 28, wherein the adjustable crank assembly includes primary and secondary cranks, and a timing belt, wherein the primary gear is sized larger relative to the secondary gear; wherein the primary crank and the timing belt connect the primary gear and the secondary gear; wherein the primary crank and the timing belt enable the secondary gear to rotate around the primary gear; and wherein the secondary crank is pivotally attached to the secondary gear and to the rearward end of the foot link.

31. The variable stride elliptical exercise device of claim 28, further including an actuation device operably coupled to the adjustable crank assembly for selectably positioning the crank assembly between at least the first and second positions.

32. The variable stride elliptical exercise device of claim 31, wherein the actuation device is positioned within the reach of a user during use of the exercise device.

33. The variable stride elliptical exercise device of claim 28, further including first and second swing anus pivotally connected to the frame, wherein each swing arm has an upper portion extending above the pivotal connection and a lower portion disposed below the pivotal connection.

34. The variable stride elliptical exercise device of claim 33, wherein the lower portion of the first and second swing arms are coupled to the first and second foot links, respectively.

35. The variable stride elliptical exercise device of claim 29, wherein the first and second foot links each include at least one roller, and wherein the at least one guide track has an upper surface that is adapted to rollably receive the foot link roller and wherein the rollers reciprocally engage the guide track.

36. The exercise device of claim 10 further comprising a crank, wherein the rearward end of the foot link has a pivot connection pivotably connecting the rearward end of the foot link to the crank, wherein the automatic adjusting mechanism adjusts the adjustable stride mechanism to adjust a shape of a path of the pivot connection during rotation of the crank.

37. The exercise device of claim 22 wherein the rearward end of the foot link has a pivot connection pivotably connecting the rearward end of the foot link to the secondary crank, wherein the automatic adjusting mechanism adjusts the adjustable stride mechanism to adjust a shape of a path of the pivot connection during rotation of the primary crank.

38. A variable stride elliptical exercise device, comprising:

a frame having a pivot axis;

first and second foot links operably supported by the frame, each of the first and second foot links having a forward end and a rearward end;

an adjustable crank assembly rotatable about the pivot axis and coupled to the rearward end of the first and second foot links, the crank assembly including a primary gear and a secondary gear, the crank assembly positionable between at least a first position by rotation of the primary gear relative to the secondary gear, wherein the crank assembly positions the rearward ends of the first and second foot links in a generally vertical elliptical path of travel in the first position, and a second position by rotation of the primary gear relative to the secondary gear, wherein the crank assembly positions the rearward ends of the first and second foot links in a generally horizontal elliptical path of travel in the second position; and at least one guide track supported by the frame, wherein the forward end of the first and second foot links engage the at least one guide track.

39. A variable stride elliptical exercise device, comprising:

a frame having a pivot axis;

first and second foot links operably supported by the frame, each of the first and second foot links having a forward end and a rearward end;

an adjustable crank assembly rotatable about the pivot axis and coupled to the rearward end of the first and second foot links, the crank assembly including a primary gear and a secondary gear, the crank assembly positionable between at least a first position by rotation of the primary gear relative to the secondary gear, wherein the crank assembly positions the rearward ends of the first and second foot links in a generally vertical elliptical path of travel in the first position, and a second position by rotation of the primary gear relative to the secondary gear, wherein the crank assembly positions the rearward ends of the first and second foot links in a generally horizontal elliptical path of travel in the second position, wherein the adjustable crank assembly includes primary and secondary cranks, and a timing belt, wherein the primary gear is sized larger relative to the secondary gear; wherein the primary crank and the timing belt connect the primary gear and the secondary gear; wherein the primary crank and the timing belt enable the secondary gear to rotate around the primary gear, and wherein the secondary crank is pivotally attached to the secondary gear and to the rearward end of the foot link.

40. A variable stride elliptical exercise device, comprising:

a frame having a pivot axis;

first and second foot links operably supported by the frame, each of the first and second foot links having a forward end and a rearward end;

an adjustable crank assembly rotatable about the pivot axis and coupled to the rearward end of the first and second foot links, the crank assembly including a primary gear and a secondary gear, the crank assembly positionable between at least a first position by rotation of the primary gear relative to the secondary gear, wherein the crank assembly positions the rearward ends of the first and second foot links in a generally vertical elliptical path of travel in the first position, and a second position by rotation of the primary gear relative to the secondary gear, wherein the crank assembly positions the rearward ends of the first and second foot links in a generally horizontal elliptical path of travel in the second position; and first and second swing arms pivotally connected to the frame, wherein each swing arm has an upper portion extending above the pivotal connection and a lower portion disposed below the pivotal connection.

* * * * *